US006216682B1

(12) United States Patent
Nambu et al.

(10) Patent No.: US 6,216,682 B1
(45) Date of Patent: Apr. 17, 2001

(54) CUTTING APPARATUS

(75) Inventors: Koji Nambu; Toru Kamikura, both of Tokyo (JP)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 09/340,361

(22) Filed: Jun. 28, 1999

(30) Foreign Application Priority Data

Jul. 6, 1998 (JP) ..... 10-190391

(51) Int. Cl.[7] ..... B28D 1/04

(52) U.S. Cl. ..... 125/13.01; 125/13.02; 125/13.03; 125/15

(58) Field of Search ..... 125/13.01, 13.03, 125/13.02, 15

(56) References Cited

U.S. PATENT DOCUMENTS 6,073,451 * 6/2000 Tarumizu ..... 62/62
6,095,899 * 8/2000 Elmar et al. ..... 451/28
6,105,567 * 6/2000 Sun et al. ..... 125/13.01

* cited by examiner

*Primary Examiner*—Stephen F. Gerrity
*Assistant Examiner*—Shantese McDonald
(74) *Attorney, Agent, or Firm*—Weingarten, Schurgin, Gagnebin & Hayes LLP

(57) ABSTRACT

A cutting apparatus having a chuck table for holding a workpiece and cutting means for cutting the workpiece held by the chuck table. The cutting means includes a spindle unit, a blade to be attached to a rotating spindle of the spindle unit, a cutting-water supplying nozzle for supplying cutting water to the blade and the workpiece, and an air-blowing nozzle provided adjacent to the blade, for supplying air to a peripheral portion of the blade. The cutting-water supplying nozzle and the air-blowing nozzle are provided on a blade cover for covering the blade. Air-blowing piping for feeding air to the air-blowing nozzle is arranged within the spindle unit. Air forced through the air-blowing piping is fed into the air-blowing nozzle, and is blown against the cutting edge of the blade, eliminating cutting water clinging to the cutting edge to carry out setup for adjusting the blade surely and precisely.

4 Claims, 5 Drawing Sheets

CUTTING APPARATUS

BACKGROUND OF THE INVENTION

1. Field of the Invention

The present invention relates to a cutting apparatus for cutting a workpiece such as a semiconductor wafer.

2. Background Art

As a conventional apparatus for cutting workpieces such as a semiconductor wafer, a cutting apparatus as shown in FIG. 6 is known. In this cutting apparatus, a cassette 1 is mounted on a cassette mounting section A which moves up and down. In the cassette 1 are stored semiconductor wafers 2 as the workpieces. A semiconductor wafer 2, which is fixed on a frame 4 via a tape 3, is carried out therefrom to a standby section B by carrying means 5. Then, the carried semiconductor wafer 2 is conveyed to a chuck table 7 by a swing arm 6. The semiconductor wafer 2 held on the chuck table 7 is positioned by alignment means 8, and then cut by cutting means 9.

In the cutting by the aforesaid cutting means 9, the semiconductor wafer 2 is cut by a blade 10 rotating at a high speed while being supplied with cutting water. Here, due to wear of cutting edge thereof and suchlike, the blade 10 may sometimes generate variations in depth of cut. The occurrence of such variations lowers the cutting accuracy as well as adversely affects the subsequent processing steps.

On this account, setup for adjusting the blade 10 to its correct position is conducted in the cutting process. However, some of the cutting water supplied in cutting is clinging to the cutting edge of the blade 10, giving rise to a problem in that the setup cannot be carried out surely and precisely.

SUMMARY OF THE INVENTION

In order to solve such conventional problem, an object of the present invention is to provide a cutting apparatus in which the setup of the blade can be carried out surely and precisely.

The foregoing object and other objects of the present invention have been achieved by the provision of a cutting apparatus comprising at least a chuck table for holding a workpiece and cutting means for cutting the workpiece held by the chuck table, wherein: the aforesaid cutting means comprises a spindle unit, a blade to be attached to a rotating spindle of the spindle unit, and a cutting-water supplying nozzle for supplying cutting water to the blade and the workpiece; and the aforesaid cutting means is further provided with an air-blowing nozzle adjacent to the aforesaid blade, the air-blowing nozzle for supplying air to the peripheral portion of the blade.

In the cutting apparatus, the aforesaid cutting-water supplying nozzle and said air-blowing nozzle may be provided on a blade cover for covering the blade.

Moreover, air-blowing piping for feeding air to the aforesaid air-blowing nozzle may be arranged within the spindle unit.

According to the present invention described above, since the air-blowing nozzle is arranged adjacent to the blade, air can be blown from the air-blowing nozzle to the blade, in advance of the setup or in carrying out the setup, to surely remove the cutting water clinging to the blade. This brings about an effect that both contact and non-contact type setup can be carried out surely and precisely.

Besides, in the contact type setup, not only the cutting water on the blade but that on the chuck table can be eliminated as well. In the non-contact type, the cutting water and contaminants clinging to its light emitting element and light receiving element can be removed. Accordingly, it is possible to improve the setups in accuracy.

Furthermore, arranging the piping of the air-blowing nozzle within the spindle unit can eliminate the obstacle to the indexing move of the spindle unit as well as avoid the contamination to the surface of workpieces due to the dropping water after the cutting.

BRIEF DESCRIPTION OF THE DRAWINGS

This and other objects and advantages of the present invention will become clear from the following description with reference to the accompanying drawings, wherein:

FIGS. 4(A) and 4(B) are diagrams illustrating the setup of a blade; among which, FIG. 4(A) is an explanatory diagram for contact type setup, and FIG. 4(B) an explanatory diagram for non-contact type setup;

DETAILED DESCRIPTION OF THE PREFERRED EMBODIMENTS

Figure 1:
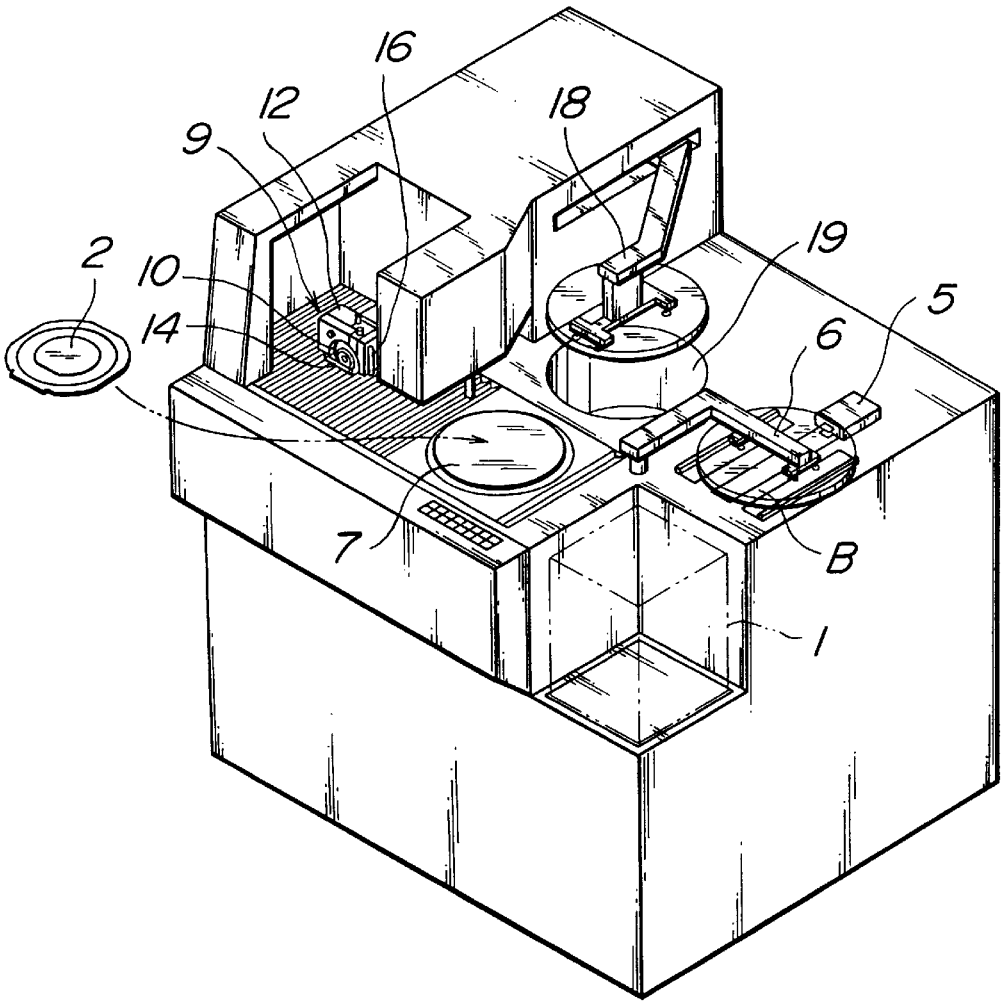
FIG. 1 is a perspective view of a cutting apparatus according to the present invention.

Hereinafter, embodiments of the present invention will be described in detail with reference to the accompanying drawings. For purposes of description, like members as those in the cutting apparatus described as of the conventional art are designated by like reference numerals or characters.

Figure 2:
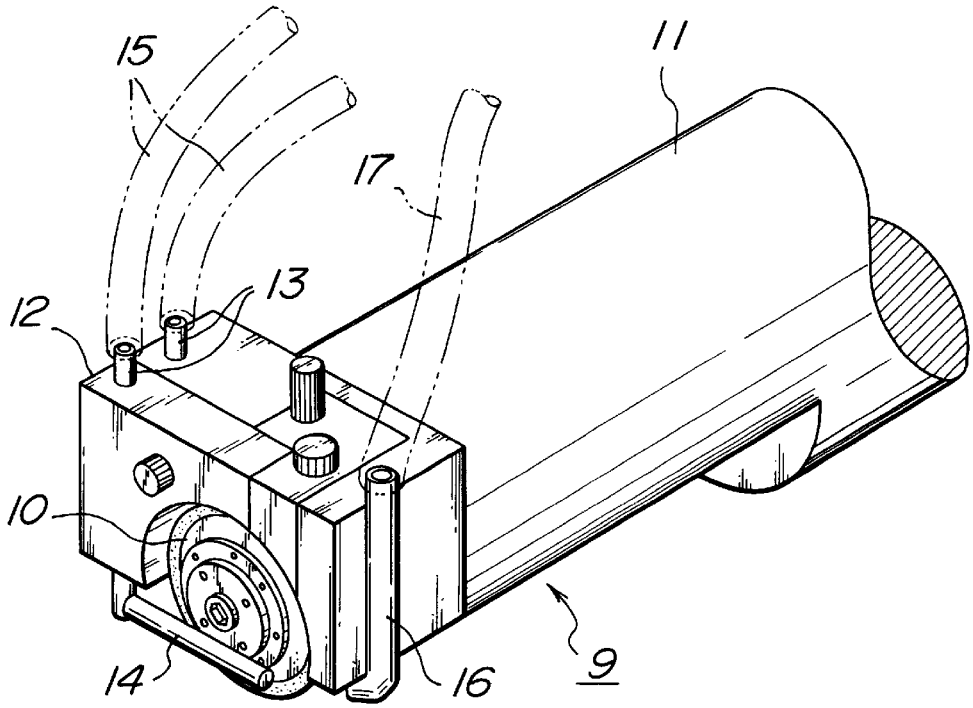
FIG. 2 is a perspective view of the main portions of the same.

FIG. 1 shows a whole cutting apparatus according to the present invention. FIG. 2 shows the main portions of cutting means 9 provided in the cutting apparatus. The cutting means 9 comprises a spindle unit 11, a blade 10 to be attached to a rotating spindle of this spindle unit 11, and a blade cover 12 for covering the blade 10.

The blade cover 12 has a pair of guide pipes 13 piercing through its side portion vertically. A pair of cutting-water supplying nozzles 14 are provided on the lower ends of the guide pipes 13 so as to horizontally face each other beyond the blade 10. The upper ends of the guide pipes 13 are projected from the upper surface of the blade cover 12, and on the respective upper ends are connected cutting-water supplying tubes 15. Cutting water forced through the cutting-water supplying tubes 15 is fed through the guide pipes 13 into the cutting-water supplying nozzles 14. From the cutting-water supplying nozzles 14, the cutting water is sprayed onto the peripheral portion (cutting edge) of the blade 10.

Figure 3:
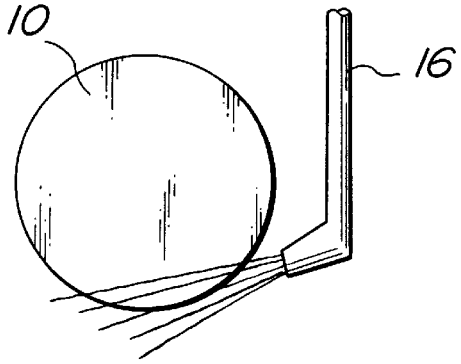
FIG. 3 is an explanatory diagram showing the operation of an air-blowing nozzle.

On the other side portion of the blade cover 12 is arranged an air-blowing nozzle 16. As shown in FIG. 3, the lower end of the nozzle 16 is formed to bend toward the peripheral portion of the aforesaid blade 10. To the upper end of the nozzle 16 is connected air-blowing piping 17. Thereby, air forced through the air-blowing piping 17 is fed into the air-blowing nozzle 16, and is blown through the lower end thereof against the peripheral portion of the blade 10.

Figure 4A:
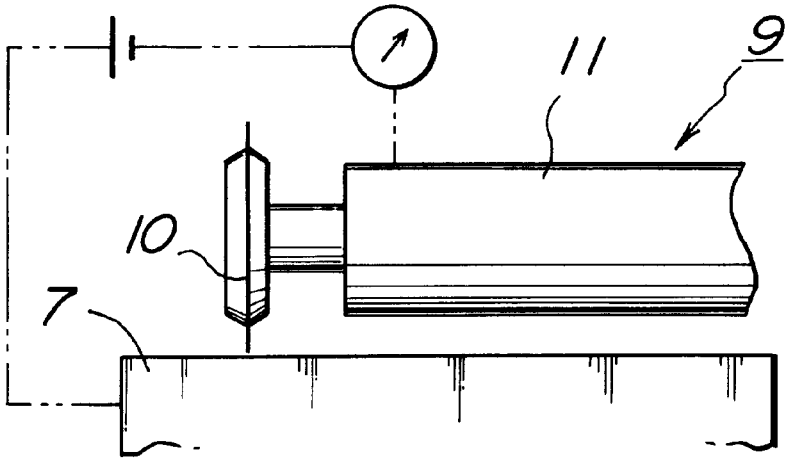
Figure 4B:
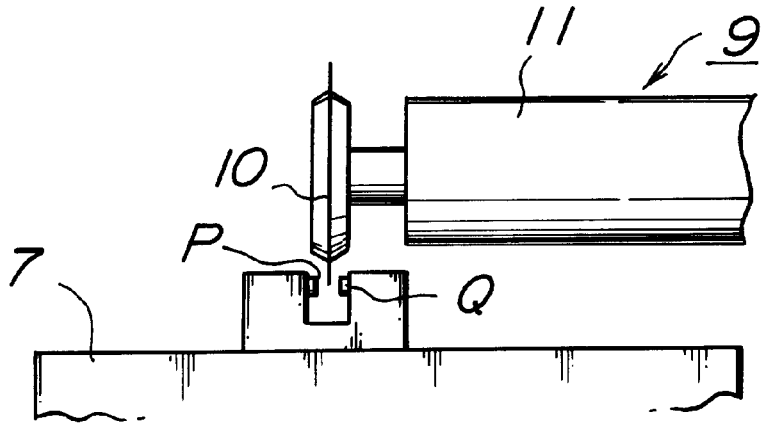

FIGS. 4(A) and 4(B) illustrate the setup of the blade 10, which is to be conducted prior to and in process of the cutting of a workpiece (semiconductor wafer 2). More specifically, FIG. 4(A) illustrates contact type setup, i.e., a method of using electric means, in which the rotating blade 10 is put into contact with an end of the upper surface of a chuck table 7, and the current flowing the closed electric circuit is detected to confirm the edge position of the blade 10. FIG. 4(B) illustrates non-contact type setup, i.e., a method of using optical means, in which the rotating blade 10 is put between a light emitting element P and a light receiving element Q, and interception of the light beam therebetween is detected to confirm the edge position of the blade 10.

In both the methods, blowing air from the aforesaid air-blowing nozzle 16 in advance of the setup or in the process of the setup can surely eliminate the cutting water clinging to the blade 10, which makes it possible to carry out the setups surely and precisely.

Particularly, in the contact type setup, not only the cutting water on the blade 10 but that clinging to the contacting areas of the chuck table 7 can be removed as well. Meanwhile, in the non-contact type setup, it is possible to eliminate the cutting water and contaminants (cut chips) clinging to the light-emitting surface of the aforesaid light emitting element P and the light-receiving surface of the aforesaid light receiving element Q. As a result, the setups are improved in accuracy.

Figure 5:
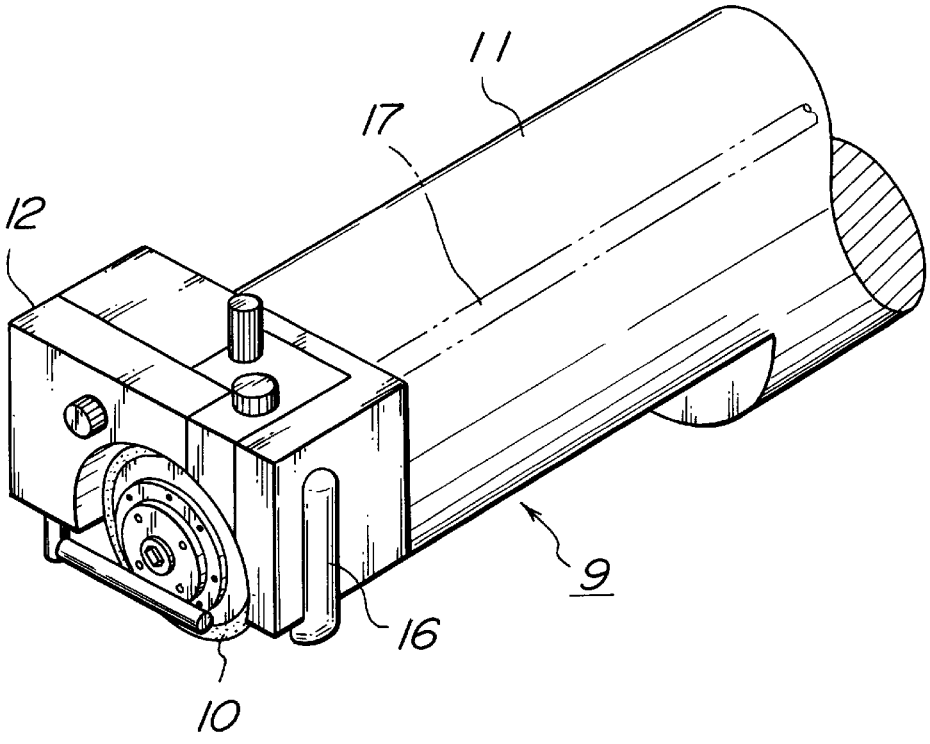
FIG. 5 is a perspective view showing the main portions of another embodiment of the present invention.
Figure 6:
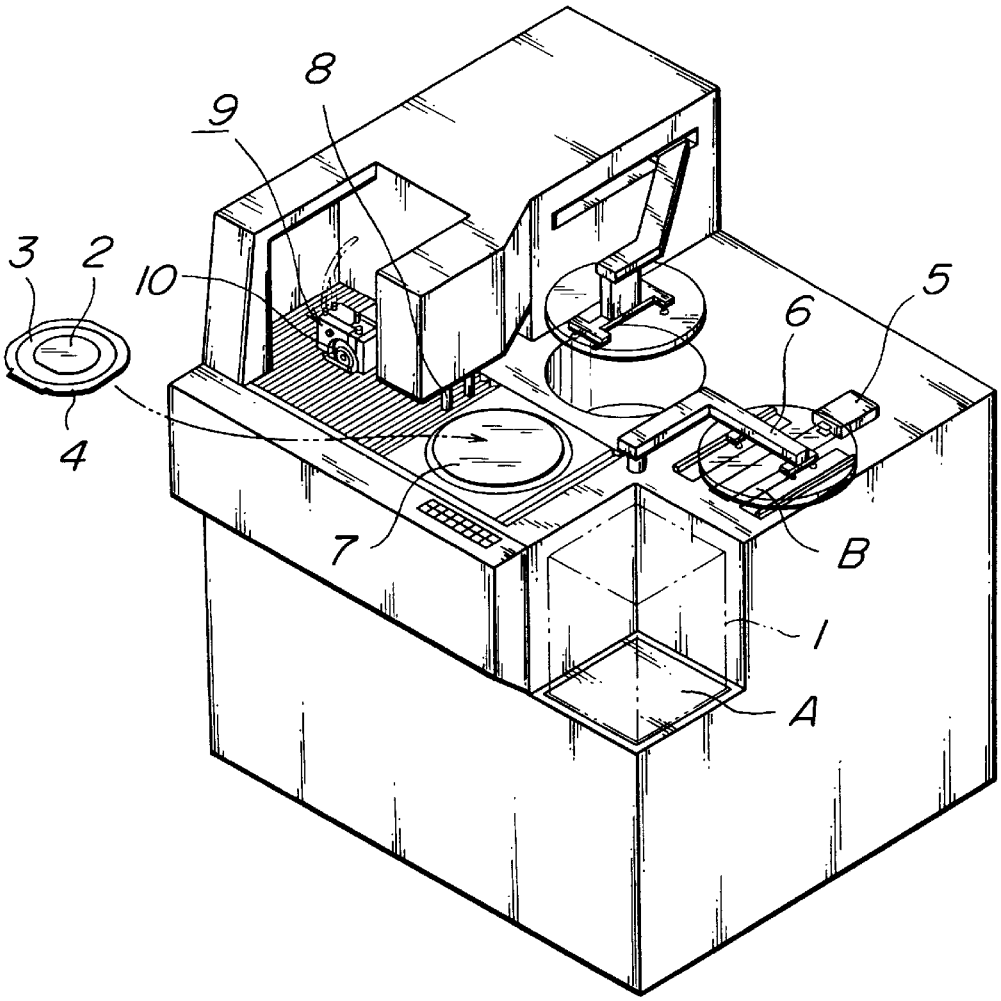
Fig. 6 Prior Art
FIG. 6 is a perspective view of a conventional cutting apparatus.

FIG. 5 shows another embodiment of the present invention, which basically has the same constitution as that described above, but is different in that the piping for the air-blowing nozzle is arranged within the spindle unit 11. More specifically, the air-blowing piping 17 is arranged in the inside of the spindle unit 11. The extremity thereof is connected to a path (not shown) formed inside the blade cover 12, and the outlet of the path is in turn connected to the upper end of the aforesaid air-blowing nozzle 16. Consequently, compressed air supplied through the air-blowing piping 17 is let through the path into the air-blowing nozzle 16, and is blown through the lower end thereof against the peripheral portion of the blade 10.

Here, the air-blowing piping 17 is not exposed to the outside; this solves a problem in that the piping tube gets caught on an adjacent member on the occasions of the indexing move of the spindle unit 11 during the cutting to obstruct the indexing move. It also eliminates a problem in that some contaminant water clinging to an exposed piping tube drops on the surface of the cut-completed semiconductor wafer 2 to contaminate the wafer. In this connection, the aforesaid cutting-water supplying tubes 15 are also preferably arranged within the spindle unit 11.

On the completion of the cutting, conveying means 18 shown in FIG. 1 conveys the semiconductor wafer 2 to washing means 19, in which the wafer is washed and dried. Then, the wafer is conveyed to the standby section B by the aforesaid swing arm 6, and then stored into the cassette 1 by the carrying means 5.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A cutting apparatus comprising at least a chuck table for holding a workpiece and cutting means for cutting the workpiece held by the chuck table, wherein said cutting means comprises:

a spindle unit;

a blade to be attached to a rotating spindle of said spindle unit;

a cutting-water supplying nozzle for supplying cutting water to said blade and said workpiece;

cutting-water supplying piping for feeding cutting water to said cutting-water supplying nozzle;

an air-blowing nozzle provided adjacent to said blade for supplying air to a peripheral portion of said blade, the air-blowing nozzle being operative to eliminate the cutting water clinging to the blade; and air-blowing piping for feeding air to said air-blowing nozzle.

2. The cutting apparatus according to claim 1, wherein: said cutting means further comprises a blade cover for covering said blade; and said cutting-water supplying nozzle and said air-blowing nozzle are provided on said blade cover.

3. The cutting apparatus according to claim 2, wherein said air-blowing piping is arranged within said spindle unit.

4. The cutting apparatus according to claim 1, wherein said air-blowing piping is arranged within said spindle unit.

* * * * *